US007603750B2

(12) United States Patent
Minter

(10) Patent No.: US 7,603,750 B2
(45) Date of Patent: Oct. 20, 2009

(54) APPARATUS ON A DRAFTING SYSTEM OF A SPINNING MACHINE, ESPECIALLY A DRAW FRAME, CARDING MACHINE, COMBING MACHINE OR THE LIKE, FOR WEIGHTING THE DRAFTING SYSTEM ROLLERS

(75) Inventor: Franz-Josef Minter, Monchengladbach (DE)

(73) Assignee: Truetzschler GmbH & Co. KG, Moenchengladbach (DE)

( * ) Notice: Subject to any disclaimer, the term of this patent is extended or adjusted under 35 U.S.C. 154(b) by 588 days.

(21) Appl. No.: 11/411,862

(22) Filed: Apr. 27, 2006

(65) Prior Publication Data

US 2006/0242798 A1 Nov. 2, 2006

(30) Foreign Application Priority Data

Apr. 29, 2005 (DE) ..... 10 2005 020 506

(51) Int. Cl.
*D01H 5/46* (2006.01)

(52) U.S. Cl. ..... 19/266; 19/270

(58) Field of Classification Search ..... 19/266–285
See application file for complete search history.

(56) References Cited

U.S. PATENT DOCUMENTS

| | | | | |
|---|---|---|---|---|
| 4,510,648 | A | 4/1985 | Mori et al. | |
| 5,761,772 | A | 6/1998 | Clapp et al. | |
| 5,799,374 | A * | 9/1998 | Strobel et al. | 19/274 |
| 6,134,752 | A | 10/2000 | Göhler et al. | |
| 6,154,931 | A | 12/2000 | Corrales | |
| 6,427,720 | B1 * | 8/2002 | Hayashi et al. | 137/554 |
| 6,469,500 | B1 | 10/2002 | Schmitz et al. | |
| 2003/0009133 | A1 * | 1/2003 | Ramey | 604/155 |
| 2003/0177848 | A1 | 9/2003 | Biester et al. | |
| 2004/0139851 | A1 | 7/2004 | Moller et al. | |
| 2004/0187269 | A1 | 9/2004 | Moller et al. | |

(Continued)

FOREIGN PATENT DOCUMENTS

| | | | |
|---|---|---|---|
| DE | 19545923 | A1 | 8/1996 |

(Continued)

OTHER PUBLICATIONS

French Patent Office Search Report, dated Jul. 27, 2007, issued for corresponding French Application No. 0651508000 (and English translation).

(Continued)

*Primary Examiner*—Shaun R Hurley
(74) *Attorney, Agent, or Firm*—Venable LLP; Robert Kinberg; Leigh D. Thelen

(57) ABSTRACT

An apparatus on a drafting system of a spinning machine, especially a draw frame, carding machine, combing machine or the like, for weighting the drafting system rollers, has at least one pressure fluid cylinder with a piston which is acted upon by pressure fluid and is arranged so as to be axially movable inside a cylinder housing and from which a piston rod extends. The piston rod passes through at least one cylinder cover that forms the end boundary of the cylinder housing. For determining the position of the piston with the piston rod, an optical distance sensor scans the distances with respect to a counter-element and the distance sensor is connected to an evaluation device.

23 Claims, 5 Drawing Sheets

U.S. PATENT DOCUMENTS

| | | | | |
|---|---|---|---|---|
| 2006/0242798 | A1 | 11/2006 | Minter | |
| 2008/0087000 | A1* | 4/2008 | Minter | 57/264 |

FOREIGN PATENT DOCUMENTS

| | | | |
|---|---|---|---|
| DE | 103 14 428 | A1 | 10/2004 |
| DE | 10 2004 046 107 | A1 | 4/2006 |
| DE | 10 2005 004 908 | A1 | 8/2006 |
| DE | 10 2005 020 506 | A1 | 11/2006 |
| EP | 0 166 521 | A1 | 1/1986 |
| EP | 0 338 966 | A2 | 10/1989 |
| EP | 0 415 156 | A1 | 3/1991 |
| EP | 0422458 | A3 | 4/1991 |
| EP | 0939151 | A2 | 9/1999 |
| EP | 1 081 390 | A2 | 8/2000 |
| EP | 1 428 914 | A2 | 6/2004 |
| EP | 1464741 | A2 | 10/2004 |

OTHER PUBLICATIONS

United Kingdom Search Report, dated Aug. 7, 2006,issued in Application No. GB0608276.2.

Handbuch fur elektrishes Messen mechanischer Groβen ("Handbook for electric Measuring of mechanical Course"), Rohrbach, Christof, VDI-Verlag GmbH Dusseldorf, pp. 234-242 (1967).

German Patent Office Search Report, dated Apr. 18, 2007, issued for corresponding German Application No. 10 2006 048 742.7 (and English translation of Section C), which corresponds to related U.S. Appl. No. 11/907,355.

United Kingdom Intellectual Property Office Search Report, dated Dec. 21, 2007 issued for Great Britain Application No. GB0719790.8, which corresponds to related U.S. Appl. No. 11/907,355.

* cited by examiner

Section K - K

APPARATUS ON A DRAFTING SYSTEM OF A SPINNING MACHINE, ESPECIALLY A DRAW FRAME, CARDING MACHINE, COMBING MACHINE OR THE LIKE, FOR WEIGHTING THE DRAFTING SYSTEM ROLLERS

CROSS REFERENCE TO RELATED APPLICATION

This application claims priority from German Patent Application No. 10 2005 020 506.2, dated Apr. 29, 2005, the entire disclosure of which is incorporated herein by reference.

BACKGROUND OF THE INVENTION

The invention relates to an apparatus on a drafting system of a spinning machine, especially a draw frame, carding machine, combing machine or the like, for weighting the drafting system rollers, having at least one pressure fluid cylinder with a piston which is acted upon by pressure fluid and is arranged so as to be axially movable inside a cylinder housing and from which a piston rod extends.

In a known apparatus (EP 1 428 914 A), a switching disc is frictionally mounted coaxially with the piston so as to be displaceable on the piston rod, which switching disc cooperates with a switch to determine the position of the piston. The switching disc is at least partly permanently magnetic in order to cooperate with an inductive sensor as a switch for determining the position of the piston. If a winding (lap) of fibre material then forms around the upper roller, the floating upper roller is pressed in the direction of the pressure fluid cylinder.

The presser rod of the pressure fluid cylinder making contact with the upper roller consequently moves in the direction of its retracted end position. When the presser rod is retracted, the switching disc, which is frictionally mounted thereon, closes the switch and the drafting system is switched off. The drafting system can then be opened manually and the lap removed. The drafting system can then be brought into the operating position again by closing the weighting arm.

It is an aim of the invention to provide an improved apparatus on a drafting system for determining the position of the piston with the piston rod.

SUMMARY OF THE INVENTION

The invention provides an apparatus on a drafting system of a spinning machine for weighting a drafting system roller, comprising:

a cylinder;

a piston axially movable within the cylinder;

a piston rod extending from the piston for applying weighting to the roller;

a sensor; and an evaluation device;

wherein the sensor is an optical sensor arranged to determine a distance between the sensor and a counter-element and the sensor is connected to the evaluation device for determining the position of the piston and piston rod.

The apparatus according to the invention makes it possible to use control technology to monitor the movement of the piston, including the platform, in both directions, up and down, for example by means of optical sensor heads of a distance sensor. As a result of the travel of the pistons in both directions, the distance between the platform and the optical sensor changes, which consequently in turn transmits a changed output signal to the control means. By virtue of the changed output signal, the control means is able to identify the movement of the piston in both directions. Furthermore, the control means is able to ascertain by means of the signals the path travelled by the piston. By means of that exact measurement and by means of the maximum value for the upward excursion of the upper roller caused by lap formation, which value is stored in the control means, the fault "lap formation" can be precisely identified. The value of the upward excursion up until a fault message is given can accordingly be made freely programmable and can be changed as required. A further advantage of such distance measurement is that precise identification of both lap formation and wear to the upper rollers can be effected automatically by the control means using an optical sensor. The upper rollers of the drafting system are routinely provided with a resilient covering, for example of rubber or the like. In one preferred arrangement, when the machine is first started up with new upper rollers, the drafting system is closed and acted upon by compressed air. The optical sensor ascertains the distance between the sensor and the platform of the piston and stores that value in the control means. The value ascertained is used to calculate the roller diameter of a new upper roller, from which there is obtained, after subtraction of the maximum wear value (stored in the control means as a fixed or variable parameter), a minimum roller diameter. The minimum roller diameter is likewise stored. As a result of the wear and abrasion to the upper rollers, that distance becomes increasing larger. By always calibrating the sensor each time the drafting system is closed, the distance with respect to the platform is ascertained afresh each time. The newly ascertained value forms the current diameter of the upper roller. The control means compares the currently ascertained diameter with the fixed programmed parameter for the wear i.e. the stored value for the minimum upper roller diameter. When the minimum roller diameter of the upper roller is reached, the machine switches to fault mode and switches off. The upper rollers must be replaced by new rollers. The machine can be started up again only when distance measurement indicates a roller diameter greater than the pre-set minimum roller diameter has been reached. Optical distance measurement inside the presser arms in accordance with the invention can achieve a wear-free and tolerance-independent measurement in both directions of the pistons that is absolutely precise; also automatic monitoring of lap formation and of wear to the upper rollers. If necessary, all stored values relating to lap formation and the wear behaviour of the upper rollers can be retrieved from the control means for statistical purposes. The machine cannot be started up with worn upper rollers. As a result, material wastage caused by worn upper rollers is not possible.

In one embodiment, the distance sensor is in fixed position and the counter-element is movable relative to the distance sensor, for example, the counter-element is, or is a part of, the piston. In another embodiment, the distance sensor is movable and the counter-element is in fixed position relative to the distance sensor. If desired, the apparatus can be used for lap display. As well or instead the apparatus can be used for displaying wear to the rollers.

In one advantageous embodiment, the counter-element has a flat scanning surface. Preferably, the scanning surface is able to reflect light beams. Advantageously, the distance sensor is a light sensor. Advantageously, the distance sensor has a transmitter and a receiver. The distance sensor may be a laser sensor. The distance sensor may use visible light. The distance sensor may use infra-red light. Advantageously, the distance sensor for location determination is mounted at an angle of 90° to the horizontal base surface of the counter-element. Advantageously, the distance sensor and the counter-element are arranged in a closed housing. Advantageously, the distance sensor is connected to an electrical evaluation device. Advantageously, the evaluation device is connected to an electronic control and regulation device. The distance sensor may be an analog sensor. In one embodiment, an optical distance sensor may scan the distances with respect to a sloping surface of the counter element.

Advantageously, the drafting system comprises three upper rollers with three presser arms. Advantageously, the drafting system comprises four upper rollers with four presser arms. Advantageously, the sensor is able to detect the movements of the piston in two directions. Advantageously, the electronic control and regulation device is able to ascertain the path changes of the piston. Advantageously, the maximum value for the excursion of the upper roller caused by lap formation is storable in the control and regulation device. Advantageously, the value of the excursion up until a fault message is given is freely programmable. Advantageously, the sensor is calibratable on each operation of closing the drafting system. Advantageously, the electronic control and regulation device comprises a 4-channel evaluation device. Advantageously, measured values relating to lap formation and/or to the wear behaviour of the upper rollers are storable.

The invention also provides an apparatus on a drafting system of a spinning machine, especially a draw frame, carding machine, combing machine or the like, for weighting the drafting system rollers, having at least one pressure fluid cylinder with a piston which is acted upon by pressure fluid and is arranged so as to be axially movable inside a cylinder housing and from which a piston rod extends, the piston rod passing through at least one cylinder cover that forms the end boundary of the cylinder housing, there being a sensor arrangement for determining the position of the piston with the piston rod, wherein for determining the position of the piston with the piston rod an optical distance sensor scans the distances with respect to a surface of a counter-element and the distance sensor is connected to an electrical evaluation device.

DETAILED DESCRIPTION OF CERTAIN PREFERRED EMBODIMENTS

Figure 1:
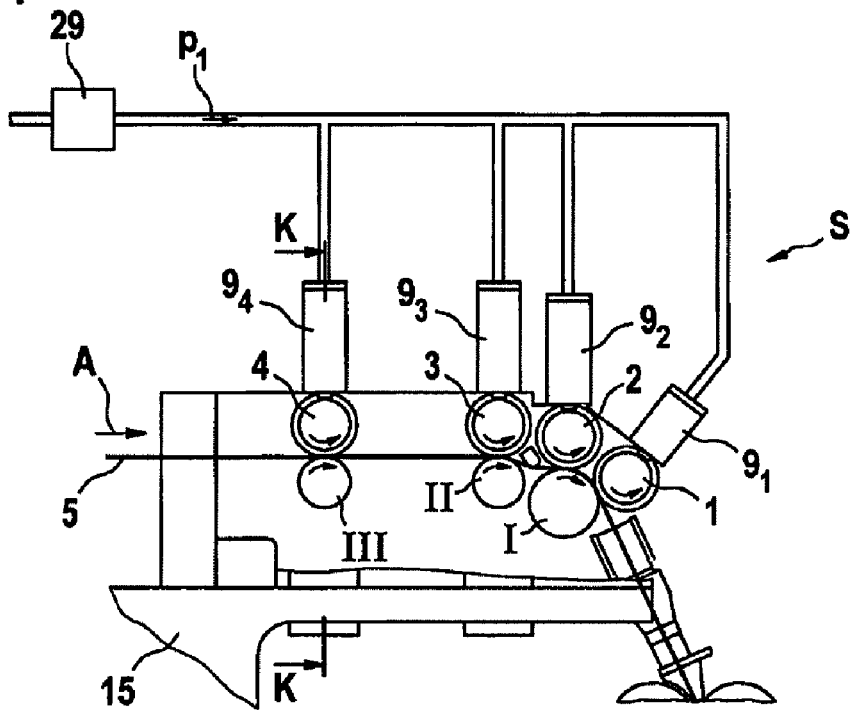
FIG. 1 is a diagrammatic side view of the drafting system of a draw frame having an apparatus according to the invention.

With reference to FIG. 1, a drafting system S of a draw frame, for example a draw frame known as a TC 03 (Trade Mark) made by Trützschler GmbH & Co. KG of Mönchengladbach, Germany. The drafting system S is configured as a 4 over 3 drafting system, that is to say it consists of three lower rollers I, II, III (I output lower roller, II middle lower roller, III input lower roller) and four upper rollers 1, 2, 3, 4. In the drafting system S, the drafting of the fibre bundle 5, which consists of a plurality of slivers, is carried out. The drafting operation is composed of the preliminary drafting operation and the main drafting operation. The roller pairs 4/III and 3/II form the preliminary drafting zone and the roller pairs 3/II and 1,2/I form the main drafting zone. The output lower roller I is driven by the main motor (not shown) and thus determines the delivery speed. The input and middle lower rollers III and II are driven by a regulating motor (not shown). The upper rollers 1 to 4 are pressed against the lower rollers I, II, III by presser elements $\mathbf{9}_1$ to $\mathbf{9}_4$ (weighting device) in presser arms 11*a* to 11*d* which are pivotable about pivot bearings (see FIG. 3) and are thus driven by way of frictional engagement. The direction of rotation of the rollers I, II, III; 1, 2, 3, 4 is indicated by curved arrows. The fibre bundle 5, which consists of a plurality of slivers, runs in direction A. The lower rollers I, II, III are mounted in stands 14 (see FIG. 3) which are arranged on the machinery frame 15. Reference numeral 29 denotes a compressed air supply.

Figure 2:
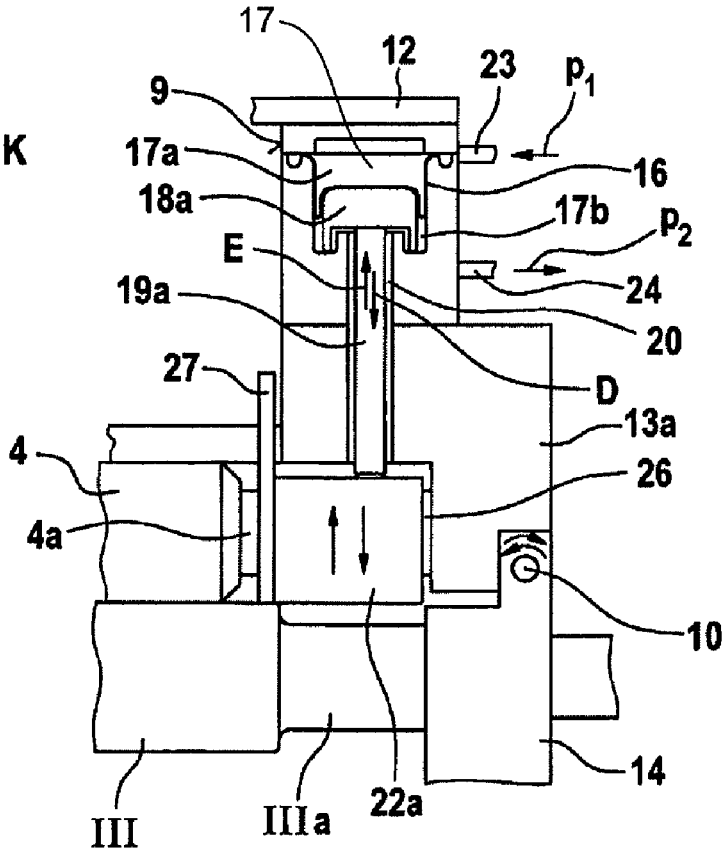
FIG. 2 shows a portion of FIG. 1 in section corresponding to K-K (FIG. 1) with a pneumatic upper roller weighting device.

According to FIG. 2, a pneumatic cylinder 9, as one of the presser elements, is associated at the top with a support element 12 and at the bottom with a holding element 13*a*. The pneumatic cylinder 9 forms a cylinder unit with a cylinder cavity 17 having two portions 17*a* and 17*b* in which a piston 18*a* is guided by means of a presser rod 19*a* in a sliding bush 20. The roller journal 4*a* of the upper roller 4, passing through an opening in a holding bracket 27, engages in a bearing 22. The bearing 22*a* accommodating the upper roller 4 extends into a chamber between the presser rod 19 and the roller journal IIIa of the lower roller III. The bearing 22*a* is mounted by means of a shoulder 26 on the holding element 13*a*. A membrane 16 divides the cylinder cavity 17 in terms of pressure. In order that pressure is generated in the upper portion 17*a* of the cylinder cavity 17, the latter can be supplied with compressed air $p_1$ by means of a compressed air connection 23. The lower portion 17*b* of the cylinder cavity 17 vents air $p_2$by means of a vented bore 24. The upper portion of the cylinder cavity 17 can be vented and the lower portion of the cylinder cavity 17 can be supplied with compressed air in corresponding manner. In operation, after a fibre bundle 5 has been guided over the lower rollers I, II, III, the presser arms 11 are pivoted into the operating position shown in FIG. 3 and fixed in that position by a fastening device (not shown), so that the presser rollers 1, 2, 3, 4 are able to exert pressure. Such a pressing action is produced on the one hand by the fact that the presser rods 19 each rest on the corresponding bearing 22 and on the other hand because an overpressure has been generated in the cavity above the membrane 16. As a result, the presser rod 19 presses with its other end on the bearing 22 in order to create the mentioned pressing action between the upper roller 4 and the lower roller (drive roller) III. The presser rod 19 (piston rod) is displaceable in the direction of arrows D, E.

Figure 3:
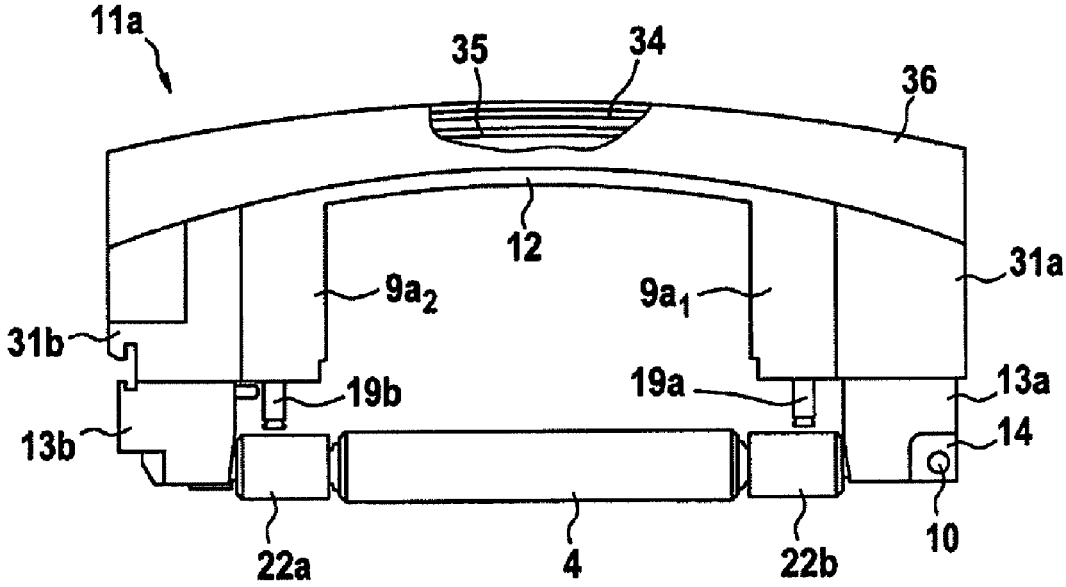
FIG. 3 is a front view of a presser arm having an integral housing and two presser rods.
Figure 3A:
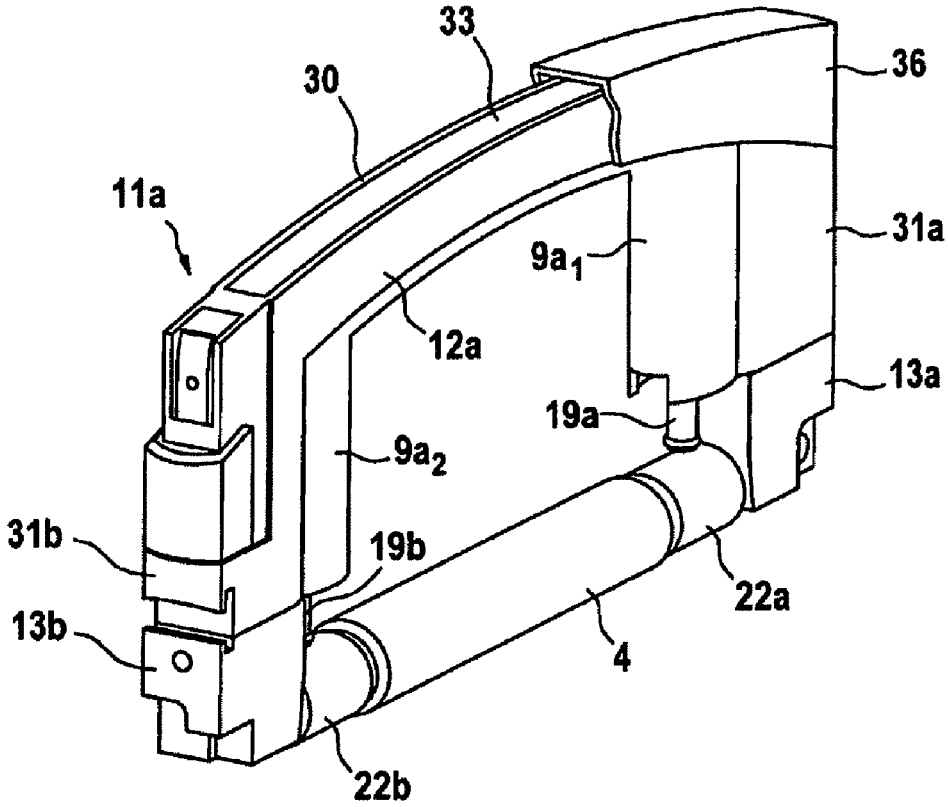
FIG. 3*a* is a perspective view of the presser arm according to FIG. 3.

According to FIG. 3, 3*a*, the upper roller 4 is associated with the portal-shaped presser arm 11*a*. (The upper rollers 2 to 4 are associated with a corresponding presser arm 11—not shown). The presser arm 11*a* is in the form of a housing 30 of glass-fibre-reinforced plastics and is produced by injection-moulding. The housing 30 is an integral component which is of unitary construction and comprises the support element 12, the two bodies of the pressure elements $9a_1$ and $9a_2$ (pressure cylinders), two intermediate elements 31*a* and 31*b* and two holding elements 13*a* and 13*b*. The support element 12*a* is in the form of a channel 33 of approximately U-shaped cross-section that is open on one side, in the interior of which pneumatic lines 34 and electrical leads 35 are arranged. The open side of the channel 33 is closable by a removable cover 36 which consists of glass-fibre-reinforced plastics, is approximately U-shaped in cross-section and is resilient so that it is attached to the channel 33 by a press-fit connection. The housing 30 is preferably formed in one piece. The integral housing 30, which combines all essential functional elements for holding and weighting the respective upper rollers 1 to 4, is in this way economical to produce. At the same time, the entire presser arm 11*a* to 11*d* is in simple manner pivotable about the pivot bearing 10 and can be locked and unlocked by a locking device (not shown). The presser rods 19*a* and 19*b* are relieved of load and thus raised from the bearings 22*a* and 22*b* of the upper roller 4.

Figure 4:
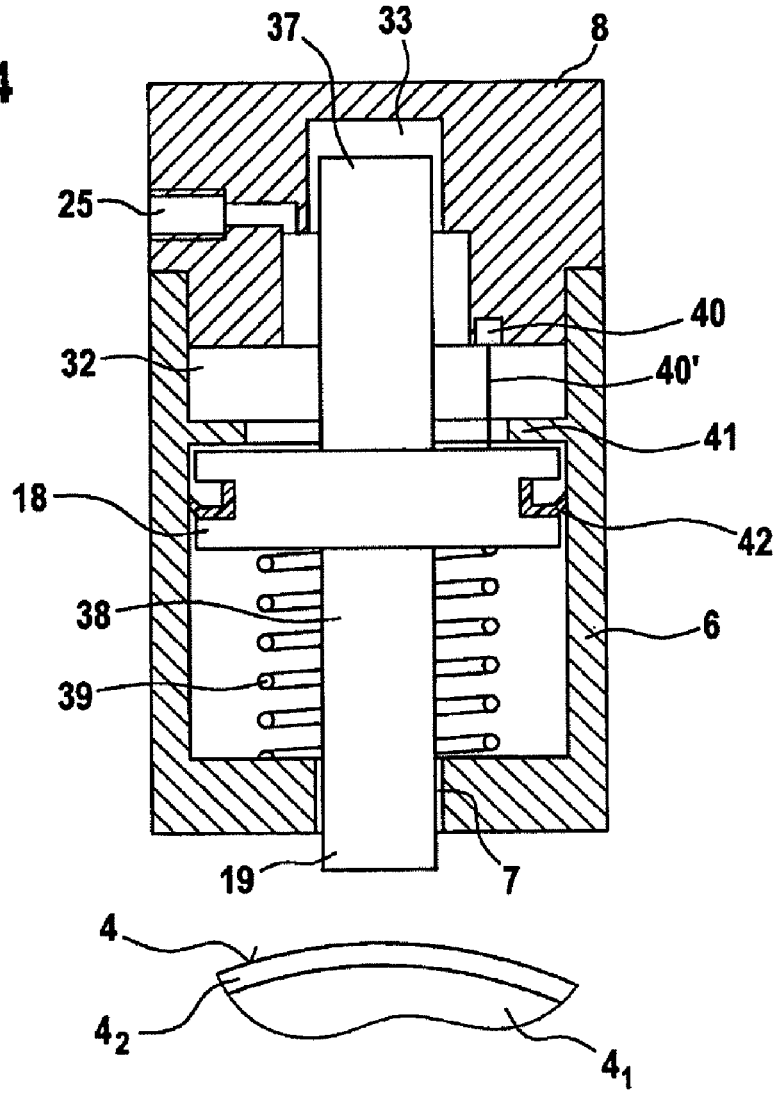
FIG. 4 shows an embodiment in which a distance sensor is arranged in the cylinder base relative to the piston.

In the embodiment of FIG. 4, the compressed-air-operated pressure fluid cylinder consists of a cylinder housing 6 in which a piston 18 is arranged so as to be axially movable. A piston rod 19 (presser rod) extends from the piston 18. The piston rod 19 emerges from a cover-side opening 7 of the pot-shaped cylinder housing 6. The opening 7 and the inner wall of the cylinder housing 6 serve for guiding the piston 18 with the piston rod 19. The piston rod 19 cooperates—in the manner described at the beginning—with an upper roller 4 of a drafting system for fibre material. The upper roller 4 consists of a metal cylinder $4_1$, to which a roller covering $4_2$ (hollow cylindrical in cross-section) made of an elastomer is attached. The pot-shaped cylinder housing 6 is closed with respect to the end face remote from the opening 7 by a cylinder base 8. In this embodiment, the connection between the cylinder housing 6 and the cylinder base 8 is in the form of a clip connection. The cylinder base 8 has a pressure fluid connection 25 for acting upon a pressure chamber 32 of the pressure fluid cylinder. Furthermore, in the region of the pressure chamber 32, a guide recess 33 is provided in the cylinder base 8. The guide recess 33 corresponds with a cylindrical extension 37 which is screwed into the piston rod 19 coaxially therewith to form a lengthwise extension thereof. The corresponding screw connection 38 serves simultaneously also for attaching the piston 18 to the piston rod 19. A compression spring 39 is arranged between the piston 18 and the cover 6*a* of the cylinder housing 6. Using the spring-returnable piston 18, in the non-pressurised state the piston 18 is always returned to the end position by mechanical means.

The cylinder base 8 is provided for accommodating a distance sensor 40. The distance sensor 40 is arranged in a recess 43 (see FIG. 5), which is open on one side, in the cylinder base 8 in order to detect the position of the piston 18. The light beam 40' of the distance sensor 40 passes through the pressure chamber 32 which is located on the side of the piston 18 remote from the opening 7 for the piston rod 19. Furthermore, on the cylinder housing 6 there is formed a radially inwardly directed annular shoulder 41 which acts as upper end-stop for the piston 18. Reference numeral 42 denotes a circumferential, approximately ring-shaped elastomeric seal between the piston 18 and the inner wall of the cylinder housing 6.

Figure 5:
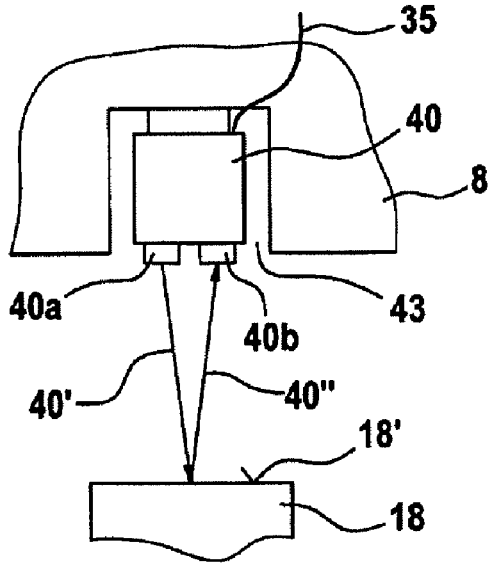
FIG. 5 shows the distance sensor with transmitter and receiver.

According to FIG. 5, the optical distance sensor 40 is arranged in fixed position in a recess 43, which is open on one side, in the cylinder base 8. The distance sensor 40 (light sensor) consists of a light transmitter 40*a* and a light receiver 40*b*. The light beam 40' emitted by the light transmitter 40*b* is reflected by the smooth surface 18' of the piston 18 and the reflected light beam 40" is received by the light receiver 40*b*. By virtue of its arrangement inside the pressure chamber 32, the distance sensor 40 is protected from dust. Reference numeral 35 denotes an electrical lead.

Figure 6:
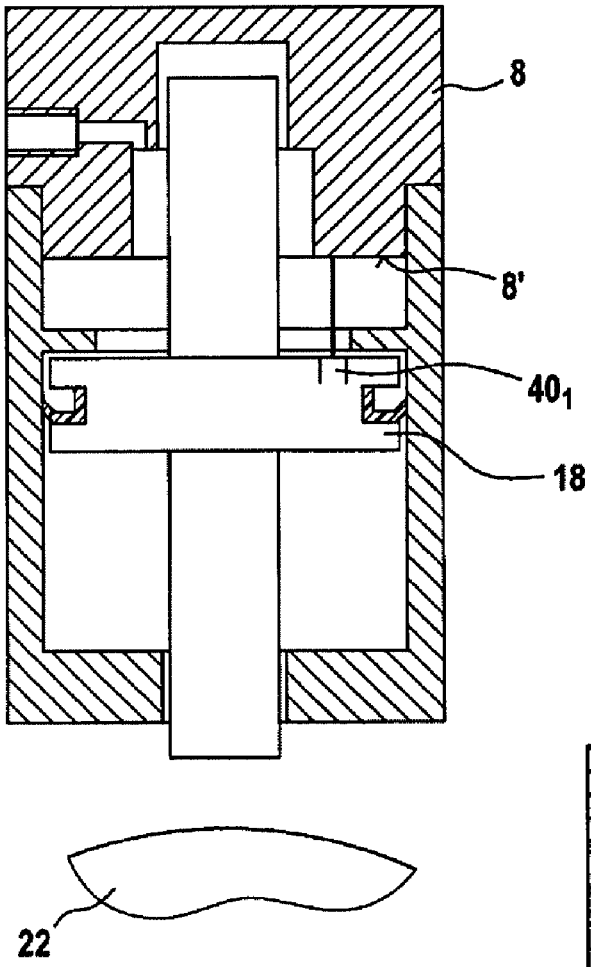
FIG. 6 shows an embodiment in which a distance sensor is arranged in the piston relative to the cylinder base.

In the embodiment of FIG. 6, a distance sensor $40_1$ is arranged in a recess, which is open on one side, in the piston 18, the light beam scanning the fixed counter-surface 8' of the cylinder base 8.

Figure 7:
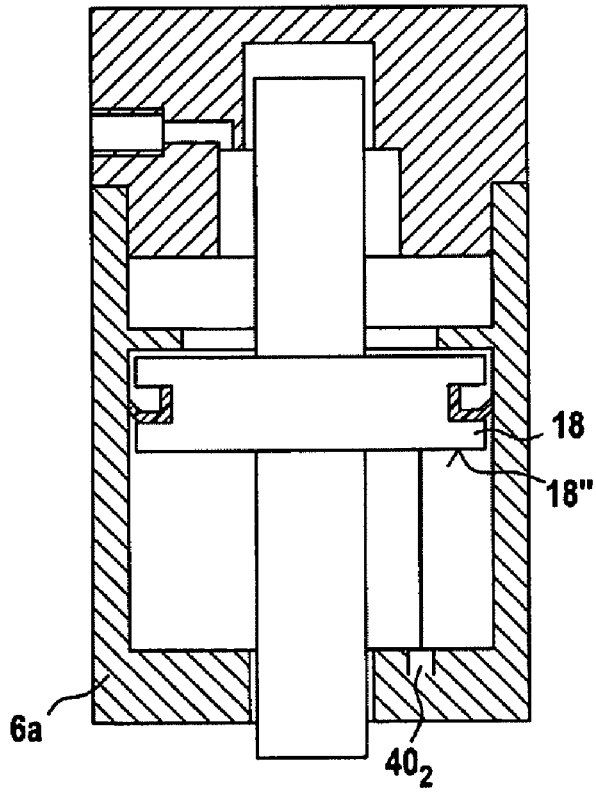
FIG. 7 shows an embodiment in which a distance sensor is arranged in the cylinder cover relative to the piston.

In the embodiment of FIG. 7, a distance sensor $40_2$ is arranged in fixed position in a recess in the cover 6*a*, the light beam scanning the counter-surface 18" of the piston 18.

Figure 8:
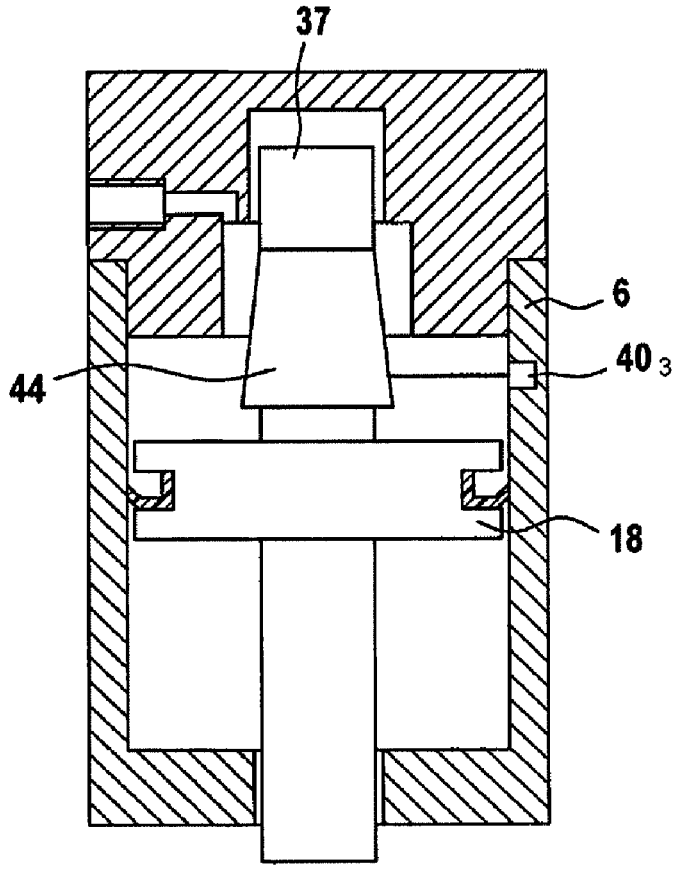
FIG. 8 shows an embodiment in which a distance sensor is arranged in the cylinder housing relative to a ramp-shaped counter-element.

In the arrangement of FIG. 8, a distance sensor $40_3$ is arranged in fixed position in a recess, which is open on one side, in the cylinder housing 6, the light beam scanning a ramp-shaped counter-element 44 mounted on the extension 37. The light scanner $40_3$ thus scans a movable sloping surface. At a given distance between the distance sensor $40_3$ and the base surface of the counter-element 44 and at a predetermined angle of inclination (a) between the base surface and the sloping surface, the evaluating device 45 (see FIG. 9) calculates the location of the piston 18 on the basis of the distance between the distance sensor $40_3$ and the sloping surface of the counter-element 44.

Figure 9:
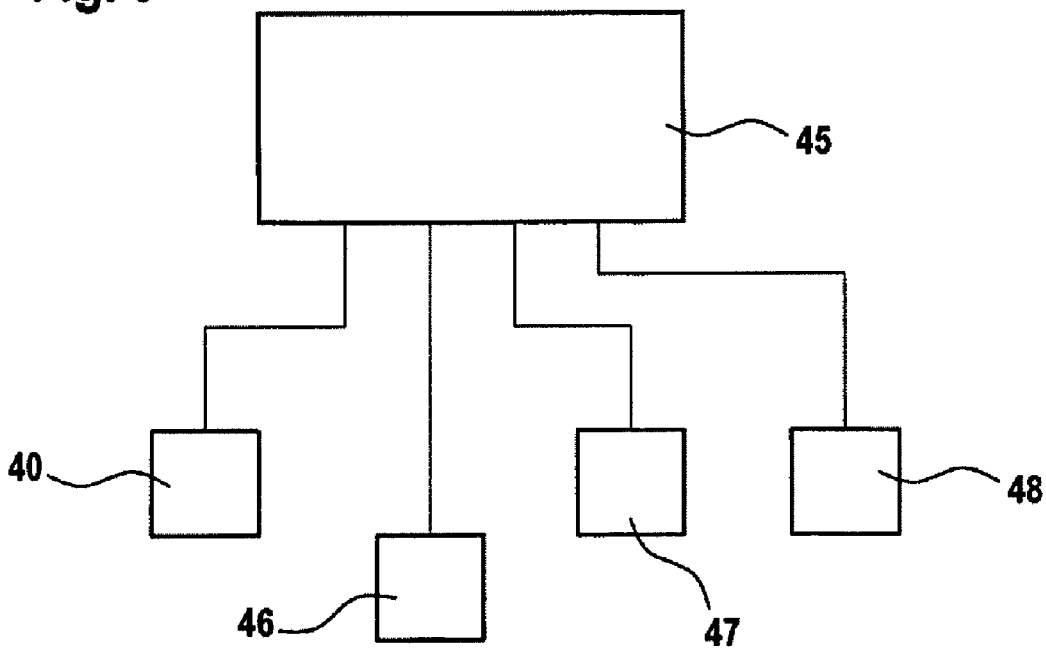
FIG. 9 is a diagrammatic block circuit diagram of an electronic control and regulation device (evaluation device) having a distance sensor, memory element, 4-channel evaluation means and display device.

In accordance with FIG. 9, the optical distance sensor 40 is connected to an electronic control and regulation device 45, for example a microcomputer having a microprocessor. Furthermore, the control and regulation device 45 is connected to a memory element 46 which is able to store the measured values of the distance sensor 40 and predetermined desired values, for example maximum and minimum values. In addition, a 4-channel evaluation device 47 and a display device 48 (lap and/or wear message) are connected to the control and regulation device 45.

Using the apparatus according to the invention, by means of the contact pressure of the piston rod 19 on the roller covering $4_2$ of the upper roller 4 and accordingly the determination of the position of the piston 18, it is possible for both lap and wear to be indicated.

Whilst the invention is described in detail above with reference to a drafting system of a draw frame, it may be applied instead, with appropriate modification, to the drafting systems of other spinning machines, in particular, of carding machines or of combing machines.

Although the foregoing invention has been described in detail by way of illustration and example for purposes of understanding, it will be obvious that changes and modifications may be practised within the scope of the appended claims.

What is claimed is:

1. An apparatus on a drafting system of a spinning machine for weighting a drafting system roller, comprising:

a cylinder;

a piston axially movable within the cylinder;

a piston rod extending from the piston for applying weighting to the roller;

an optical sensor positioned on one of the cylinder or the piston and configured to measure a distance between the sensor and a counter-surface on the other of the cylinder or the piston and produce a corresponding output signal;

an evaluation device coupled to the output signal and producing a distance signal corresponding to a measured distance of the sensor from the counter-surface to determine a position of the piston and piston rod; and an electronic control and regulation device coupled to the sensor and configured to receive the distance signal, wherein the electronic control and evaluation device is adapted to compare the distance signal to stored predetermined maximum and minimum values relating to allowable lap formation on the roller and wear to the roller, respectively.

2. An apparatus according to claim 1, wherein the sensor is in a fixed position on the cylinder and the counter-surface on the piston is movable relative to the optical sensor.

3. An apparatus according to claim 1, wherein the counter-surface is fixed on the cylinder and the sensor on the piston is movable relative to the counter-surface.

4. An apparatus according to claim 1, wherein the counter-surface comprises a flat, light-reflective scanning surface.

5. An apparatus according to claim 1, wherein the counter-surface comprises a horizontal base surface and wherein a light beam of the sensor contacts the horizontal base surface at an angle of 90° to determine the position of the piston and piston rod.

6. An apparatus according to claim 1, wherein the counter-surface comprises a sloping surface and wherein the sensor scans a distance with respect to the sloping surface.

7. An apparatus according to claim 1, wherein the sensor is arranged relative to the counter-surface to detect the movements of the piston in two directions.

8. An apparatus according to claim 1, wherein the sensor and the counter-surface are arranged in a closed housing.

9. An apparatus according to claim 1, wherein the sensor comprises a transmitter and a receiver.

10. An apparatus according to claim 1, wherein the sensor comprises one of laser sensors, distance sensors that use visible light, and distance sensors that use infra-red light.

11. An apparatus according to claim 1, wherein the sensor comprises an analog sensor.

12. An apparatus according to claim 1, wherein the electronic control and regulation device is further coupled to a memory element and a display device.

13. An apparatus according to claim 1, wherein the sensor is calibratable on each operation of closing the draft system.

14. An apparatus according to claim 1, wherein the drafting system comprises three or more presser arms.

15. An apparatus according to claim 1, wherein the drafting system comprises at least three presser arms, and wherein two or more of the presser arms each comprise a sensor and a counter-surface as defined in claim 1.

16. An apparatus according to claim 1, wherein the apparatus displays and stores measured values relating to lap formation and/or wear behavior of the rollers.

17. An apparatus according to claim 1, wherein the apparatus displays information relating to lap formation and/or wear behavior of the rollers.

18. An apparatus according to claim 1, wherein the cylinder comprises a pressure fluid cylinder.

19. An apparatus according to claim 18, wherein the pressure fluid cylinder comprises a pneumatic cylinder.

20. An apparatus according to claim 1, further comprising an extension connected to the piston and extending coaxially with the piston rod, wherein the sensor is positioned on the cylinder and the counter-surface is defined by a sloping surface of a counter-element mounted on the extension.

21. The apparatus according to claim 1, wherein the evaluation device comprises a 4-channel evaluation device.

22. The apparatus according to claim 1, wherein the predetermined maximum value comprises a freely programmable maximum value for upward excursion of the roller caused by lap formation, the apparatus further including a memory element coupled to the electronic control and regulation device to store the freely programmable maximum value, whereby the electronic control and regulation device is adapted to compare the distance signal corresponding to movement of the piston to the maximum value for upward excursion of the roller to determine lap formation on the roller.

23. The apparatus according to claim 1, wherein the predetermined minimum value comprises a freely programmable minimum value for downward excursion of the roller caused by roller wear, wherein the minimum value relates to the minimum value for a diameter of the roller, and the apparatus further including a memory element coupled to the electronic control and regulation device to store the freely programmable minimum value, whereby the electronic control and regulation device is adapted to compare the distance signal corresponding to movement of the piston to the minimum value for downward excursion of the roller to determine wear of the roller.

* * * * *

UNITED STATES PATENT AND TRADEMARK OFFICE

CERTIFICATE OF CORRECTION

PATENT NO. : 7,603,750 B2
APPLICATION NO. : 11/411862
DATED : October 20, 2009
INVENTOR(S) : Franz-Josef Minter It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 764 days.

Signed and Sealed this

Fifth Day of October, 2010

David J. Kappos

David J. Kappos
*Director of the United States Patent and Trademark Office*